US005687572A

United States Patent [19]

Schrantz et al.

[11] Patent Number: 5,687,572

[45] Date of Patent: Nov. 18, 1997

[54] THIN WALL COMBUSTOR WITH BACKSIDE IMPINGEMENT COOLING

[75] Inventors: Jeffrey P. Schrantz, Apple Valley, Minn.; David R. Squire, Phoenix, Ariz.

[73] Assignee: AlliedSignal Inc., Morris Township, N.J.

[21] Appl. No.: 970,420

[22] Filed: Nov. 2, 1992

[51] Int. Cl.[6] ..... F23R 3/06

[52] U.S. Cl. ..... 60/753; 60/752; 60/754; 431/352

[58] Field of Search ..... 102/378; 431/352; 60/752, 753, 754, 722

[56] References Cited

U.S. PATENT DOCUMENTS

| | | | |
|---|---|---|---|
| 2,405,785 | 8/1946 | Goddard | 60/754 |
| 2,564,497 | 8/1951 | Navias | 60/753 |
| 3,031,844 | 5/1962 | Tomolonius | 60/752 |
| 3,567,399 | 3/1971 | Altmann et al. | 431/352 |
| 3,584,972 | 6/1971 | Bratkovich et al. | 60/754 |
| 3,918,255 | 11/1975 | Holden | 60/753 |
| 3,934,408 | 1/1976 | Irwin | 60/753 |
| 3,981,142 | 9/1976 | Irwin | 60/753 |
| 4,050,239 | 9/1977 | Kappler et al. | 60/752 |
| 4,073,137 | 2/1978 | Roberts | 60/752 |
| 4,104,017 | 8/1978 | Alin | 431/352 |
| 4,109,459 | 8/1978 | Ekstedt et al. | 60/757 |
| 4,244,178 | 1/1981 | Herman et al. | 60/754 |
| 4,269,032 | 5/1981 | Meginnis et al. | 60/754 |
| 4,292,376 | 9/1981 | Hustler | 60/754 |
| 4,427,362 | 1/1984 | Dykema | 431/352 |
| 4,567,730 | 2/1986 | Scott | 60/753 |
| 4,695,247 | 9/1987 | Enzaki et al. | 431/352 |
| 4,838,031 | 6/1989 | Cramer | 60/753 |
| 5,027,604 | 7/1991 | Krueger | 60/752 |

*Primary Examiner*—Michael J. Carone
*Attorney, Agent, or Firm*—Jerry J. Holden

[57] ABSTRACT

A combustor for a gas turbine engine having a porous outer metallic shell and a thin-walled, nonporous ceramic liner whose backside is impingement cooled, with only primary and secondary openings in the ceramic liner for delivering pressurized primary air and dilution air to the combustion zone.

21 Claims, 2 Drawing Sheets

THIN WALL COMBUSTOR WITH BACKSIDE IMPINGEMENT COOLING

This invention was made in the course of a contract with the United States Air Force. The U.S. Government has certain rights in this invention.

BACKGROUND OF THE INVENTION

This invention pertains to combustors for use in gas turbine engines, and pertains more particularly to utilization of ceramic liners within the combustor.

The efficiency of gas turbine engine is directly related to the maximum temperatures generated therein. Increased temperature in the combustor portion of such an engine can directly increase the overall efficiency of such engine. The desire for hotter combustion temperatures is often limited by the materials thereof. While ceramic materials are known to have greater temperature capabilities, their lack of mechanical strength, susceptibility to foreign object damage, and other factors have limited the application of ceramics even within the combustor of gas turbine engines.

Another concern with combustors of gas turbine engines is that of emissions. For low NOx emissions, combustion processes such as lean premixed, prevaporized techniques, as well as rich burn, quick quench, lean burn techniques have been investigated. For such arrangements, attempts at cooling the hot side of the combustor liner structure increases NOx emissions. Thus, while cooling techniques on the combustor liner may be advantageous in increasing maximum engine temperature, they deleteriously increase NOx formation and emission.

SUMMARY OF THE INVENTION

It is an important object of the present invention to provide an improved combustor for gas turbine engines having higher temperature capability while still maintaining adequate NOx emission limitations. More specifically the present invention contemplates utilization of a ceramic matrix composite such as a silicon carbide matrix reinforced with silicon carbide fibers, commonly referred to as a SiC—SiC ceramic matrix composite.

More particularly, the present invention contemplates incorporation of a very thin-walled ceramic liner within the combustor which defines the outer limits of the combustion process, this ceramic liner preferably being of a ceramic matrix composite structure and having a wall thickness of approximately 0.025 to 0.040 inches in thickness.

Importantly, this ceramic, thin-walled combustor liner is of simple cylindrical shape readily amenable to production for such a ceramic component, and does not utilize cooling passages therein. Instead, the present invention contemplates the utilization of incoming pressurized air flow onto the backside of the ceramic liner, i.e. the side of the ceramic liner outside the combustion zone itself, to produce impingement cooling on the backside of this liner. Even though the ceramic matrix composite has a low thermal conductivity through its thickness, thus tending to normally induce high temperature differentials between the inner and outer surfaces of the ceramic liner, its thermal resistance decreases with decreasing ceramic liner thickness, and therefore the temperature drop also decreases. That is, as the liner becomes very thin, the temperature differential across it approaches zero and the liner temperature becomes almost constant.

Additionally, the present invention contemplates incorporation of a cooling space between the backside of the ceramic liner and a surrounding outer metallic shell which carries the mechanical loads of the combustor. This cooling space, coupled with the impingement cooling acting upon the backside of the ceramic liner, allows higher temperatures within the combustion zone and the combustion process. The active, impingement cooing of the backside of the ceramic liner allows combustor temperatures to be raised while the temperature of the ceramic liner and the combustor metallic shell are held within their respective material limits.

Also importantly, the present invention contemplates avoidance of increased NOx formation by assuring that all air flow used for impingement cooling, and all the cooling air flow within the cooling space, is reinjected into the combustion process itself, preferably primarily in the dilution zone of the combustion process. Thus, the present invention has no "loss" of pressurized air flow from a thermodynamic standpoint, and also does not introduce film cooling on the interior surface of the ceramic liner which would induce NOx formation.

These and other objects and advantages of the present invention are specifically set forth in or will become apparent from the following detailed description of a preferred form of the invention when read in conjunction with the accompanying drawings.

DETAILED DESCRIPTION OF THE PREFERRED EMBODIMENT

Figure 1:
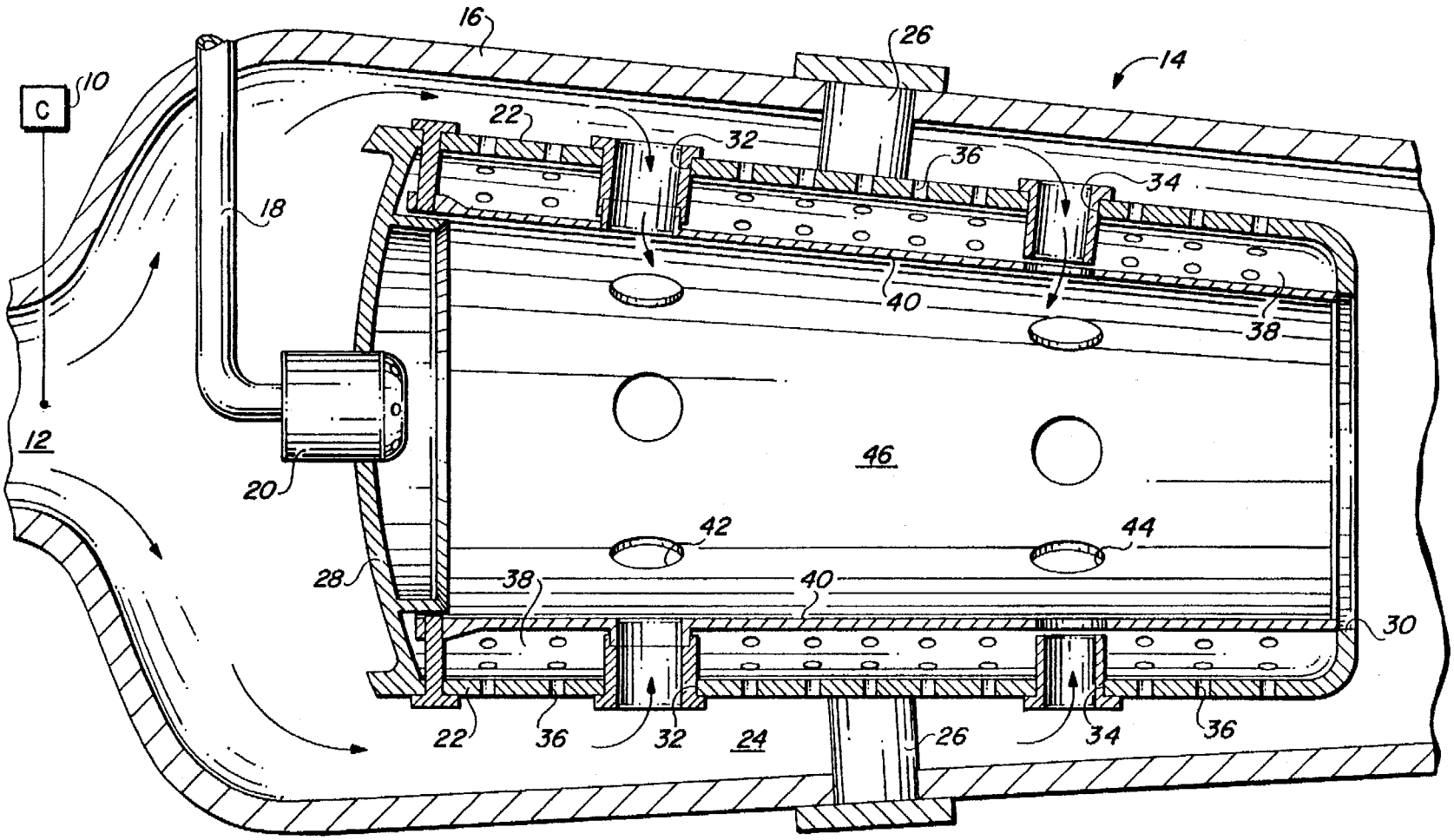
FIG. 1 is a partially diagrammatic representation of a gas turbine engine with a partial, plan cross sectional view of a combustor constructed in accordance with the principles of the present invention.

Referring now more particularly to the drawings, a gas turbine engine typically includes a compressor denoted by the reference numeral 10 which supplies pressurized air for the combustion process through an air inlet 12 of a combustor generally denoted by the numeral 14. For purposes of explanation, the combustor illustrated in FIG. 1 may be considered to be a can-type combustor. The combustor 14 includes an outer housing 16 through which fuel for the combustion process is delivered via a duct 18 to one or more fuel nozzles 20.

Within housing 16 the combustor includes an outer metallic shell 22 which receives pressurized air for the combustion process from a plenum 24 defined inside the outer housing 16. This metallic shell 22 is rigidly mounted and affixed to the combustor housing 16 such as by mounts 26 and includes an end cap or face 28 at one end thereof. The opposite end of outer shell 22 has a relatively large opening 30 from which the combustion gasses are exhausted out of the combustor after completion of the combustion process.

Figure 2:
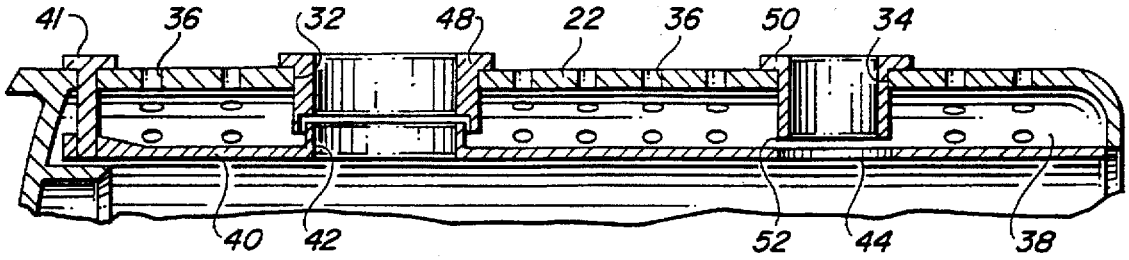
FIG. 2 is an enlarged portion of the combustor liner of FIG. 1.
Figure 3:
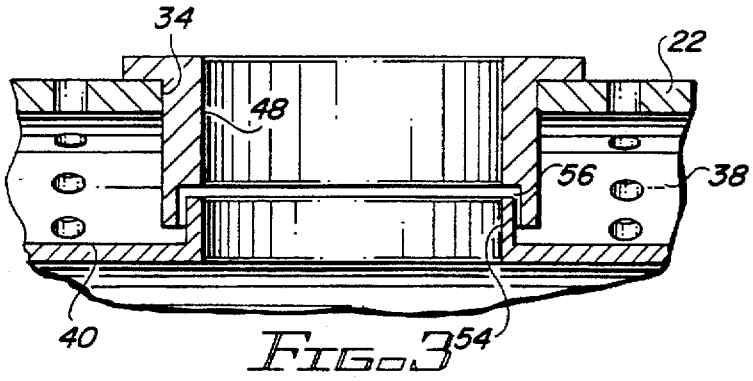
FIG. 3 is a further enlarged representation of a primary air passage of the combustor.

As shown in FIGS. 1–3, the outer shell 22 has a plurality of primary air holes 32 and a plurality of secondary air holes 34. Also, the outer shell 22 has a plurality of smaller cooling air holes 36 disposed along the axial length thereof.

The invention further includes an inner, thin walled, ceramic liner 40 disposed within the outer metallic shell 22.

Ceramic liner 40 is of generally cylindrical configuration complementary to the configuration of the outer shell 22, and is preferably constructed of a ceramic matrix composite material such as SiC—SiC. One end of ceramic liner 40 is secured such as by attachment pin 41 to outer shell 22. In this cantilevered configuration, the inner ceramic liner 40 is subject to relatively small pressure forces and low mechanical loads. The primary mechanical and pressure loads of the entire combustor are carried by the outer shell 22, and the inner liner 40 is subject primarily only to thermodynamic loading as discussed in greater detail below.

The wall thickness of liner 40 is, importantly, very thin for thermal stress purposes. Preferably, the thickness of liner 40 is less than about 0.040 inches and in the range of about 0.025 to 0.040 inches.

Liner 40 includes a plurality of primary openings 42 aligned with and communicating with the associated primary air holes 32 in the outer shell 22. Similarly, the inner ceramic liner 40 includes a plurality of secondary openings 44 likewise aligned with and corresponding to each one of the secondary air holes 34 of the outer shell 22. Other than these primary and secondary openings 42, 44, the ceramic liner 40 is substantially nonporous and impervious to the pressurized air flow, and generally bounds the combustion zone 46 located within the inside of the ceramic liner 40. Thus ceramic liner 40 defines the outer limits of the combustion process occurring inside the combustion zone 46.

Associated with each of the primary and secondary air holes 32, 34 of the outer metallic shell 22 are radially inwardly extending bosses 48 and 50 which extend generally across an annularly configured cooling space 38 defined between the outer metallic shell 22 and the inner ceramic liner 40. Bosses 48, 50 are secured to and carried upon the outer shell 22, and constitute conduit means extending across the cooling space 38 from the primary and secondary air holes 32, 34, to the primary and secondary openings 42, 44 in the inner liner so as to direct pressurized air from the plenum 24 to the combustion zone 46. Boss 50 at its inner end is spaced slightly from secondary opening 44 to define an orifice 52 which, in a flow restrictive manner, allows the exhaust of cooling air flow within cooling space 38 through the orifice 52 and the secondary opening 44 to be utilized in the combustion zone 46 as a part of the combustion process.

Preferably, inner liner 40 may be outfitted with a plurality of ceramic cylindrical bosses 54 at the primary openings 42. As best illustrated in FIG. 3, cylindrical ceramic bosses 54 extend toward the outer shell 22 and nest loosely within the associated outer boss 48. Together, bosses 54, 48 define a tortuous, flow restricting orifice path 56 therebetween. Orifice 56 is preferably of smaller area than the orifice 52 formed between secondary boss 50 and secondary opening 44. In this manner cooling air within cooling space 38 also is exhausted through orifice 56 into the primary air opening 42; however, because of the larger size of orifice 52, the majority of cooling flow within cooling space 38 exhausts through the secondary opening 44 to form part of the dilution air flow of the combustion process.

In operation, compressed air from compressor 10 enters inlet 12 into plenum 24. Fuel is delivered through duct 18 through nozzle 20 to one end, normally referred to as the combustor dome at end cap 28, of the combustion zone 46 in conventional fashion. Primary air flow for the combustion process enters the holes 32 and associated openings 42 in liner 40 to provide the primary air flow in support of the combustion process. In conventional fashion, secondary pressurized air flow for the combustion process enters secondary air holes 34 and associated air openings 44 to enter the combustion process. Products of combustion exhaust outwardly through opening 30 to perform useful work. The pressurized airflow from plenum 24 also passes through the plurality of small cooling air holes 36 into cooling space 38, and is directed to impinge upon and impingement cool the outer, or backside surface, of ceramic liner 40. "Backside surface" refers to the surface of ceramic liner 40 which is not facing the combustion zone 46. As noted, the pressurized air used for cooling into cooling space 38 is reintroduced into the combustion process through orifices 52 and 56 respectively, with the primary portion of this cooling air flow passing through larger orifice 52 to intermix within become a portion of the secondary air flow supporting the combustion process.

Figure 4:
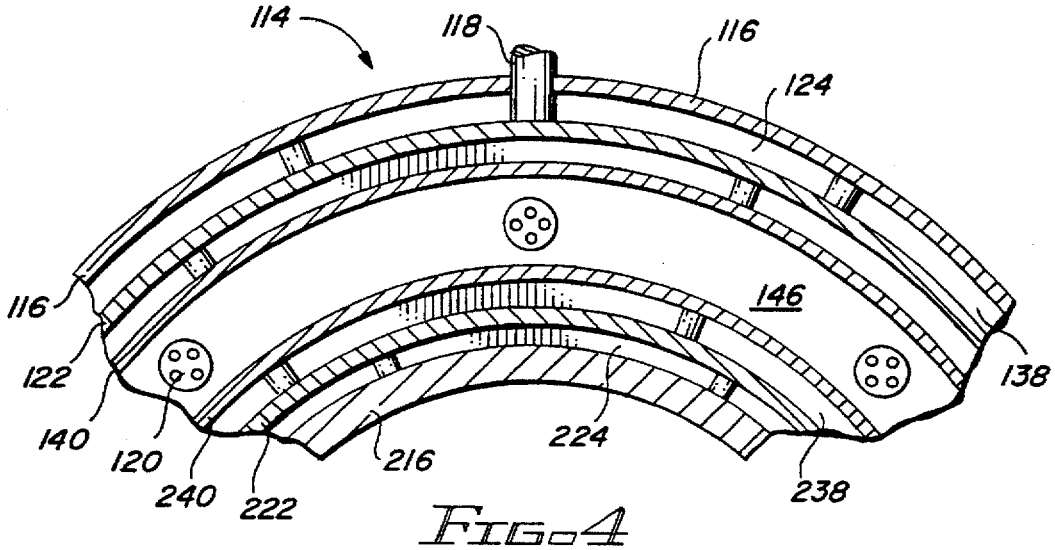
FIG. 4 is a partial end cross sectional view of an alternate, annularly shaped combustor incorporating the principles of the present invention.

FIG. 4 illustrates an alternate embodiment of the present invention, more particularly an annular combustor configuration incorporating the present invention. This combustor 114, in addition to including ducts 118 providing fuel flow to nozzles 120, has radially outer and inner combustor housing walls 116, 216 defining respective annular plenum chambers 124, 224. The annular configuration of this combustor further includes a first and second outer metallic shells 122, 222. Also included are first and second, radially outer and inner ceramic liners 140, 240 which define therebetween an annularly shaped combustion zone 146 in which combustion occurs. Thus defined are associated cooling spaces 138, 238 between the respective first and second sets of outer metallic shells and inner ceramic liners.

Other than this alteration in physical configuration, the arrangement in FIG. 1 is constructed with openings, cooling holes, and supports in a manner set forth above with respect to the FIG. 1 embodiment. The arrangement in FIG. 4 therefore operates in a manner set forth above with respect to the FIG. 1 configuration. Further the FIG. 2 and FIG. 3 illustrations are identical for both the FIG. 1 and FIG. 4 embodiments.

As noted previously, an important feature of the present invention is the very thin wall of ceramic liner 40, 140 or 240. (For simplification of explanations, the remaining discussions hereinbelow will utilize the reference numerals of FIGS. 2 and 3, it being understood that such discussion is applicable to both the "can" type and annular type combustors unless otherwise noted.).

The ceramic liner 40 acts primarily as a thermal shield, carrying substantially only its own inertial loads, a small pressure drop, and thermal stresses. Metallic outer shell 22 carries substantially all other loads including the relatively high pressure drop from the pressurized air flow passing from plenum 24 into combustion chamber 46, and also protects the liner from the ceramic liner 40 from foreign object damage and any external damage such as might occur in handling and installation.

To explain the significance of the thin wall ceramic liner 40, the ceramic matrix composite of liner 40 has the capability of substantially higher use temperatures than metal liners. On the other hand ceramic matrix composites such as SiC—SiC have very low thermal conductivity which would normally lead to high temperature differentials between the inner and outer surfaces of ceramic liner 40. High temperature differentials may induce sufficiently high thermal stresses to cause cracking of the ceramic matrix that would then expose the ceramic matrix fibers to hot, oxidizing combustor air or gasses. This of course would lead to rapid degradation of the composite strength and to the loss of its structural integrity. Thus, as normally viewed, it would be expected that backside cooling of such a ceramic liner would further aggravate the problem because of the yet further increased temperature differential through the thickness of ceramic liner 40.

The very thin wall of ceramic liner 40 of the present invention, however, relieves the difficulties caused by low thermal conductivity associated with ceramic matrix components. Specifically, as the thickness of ceramic liner 40 decreases, for a given set of thermal boundary conditions, its thermal resistance also decreases. Therefore the temperature differential through-the-thickness of ceramic liner 40 also decreases. As liner 40 becomes extremely thin, its through-the-thickness temperature differential approaches zero, and the temperature of ceramic liner 40 becomes almost constant. This very thin ceramic liner 30, with its small temperature differential therethrough, therefore allows the utilization of impingement cooling on the backside of the ceramic liner 40 without creating such high temperature differentials and thermal stresses that would crack the matrix.

With utilization of the efficient backside cooling technique of impingement cooling as offered offered by the present invention, the combustor temperatures maintain within combustion zone 46 may be raised substantially higher than previously, while the liner 40 temperature and the metallic outer shell 22 temperatures are both held within their respective material limits. Because a large amount of cooling can be accomplished, combustion temperatures can be raised without pushing the ceramic liner 40 beyond its material temperature limit. This occurs since the impingement cooling jets impinging upon the backside of ceramic liner 40 create high heat transfer coefficients on the backside of the liner in the cooling space 38, perhaps 4 to 10 times that of a typical combustor. Again, the thin ceramic liner allows this to be accomplished without causing prohibitively high stresses because of the extremely thin thickness of the wall of ceramic liner 40.

In this process, effusion cooling and film cooling of the inner surfaces of the ceramic liner 40 which are exposed to the combustion processes within combustion zone 46, are avoided. This maintains low NOx formation. Additionally, because all of the air utilized for impingement cooling is reintroduced back into either the primary or secondary air flows, efficiency losses normally associated with cooling techniques are thereby avoided.

Analyses have been conducted for ceramic liners 140 of thicknesses of 0.040, 0.035, and 0.030 inches. A ceramic liner thickness of 0.040 is considered as a baseline case because of the high level of confidence in manufacturing a cylindrical shape for a liner having this thickness. For such a ceramic liner 140, a maximum temperature differential across the liner can be expected to be about 397° F., leading to a thermally induced stress of about 9.71 ksi. Typically, the design criteria limit for SiC—SiC ceramic matrix composite is at 10 ksi.

Similarly, analyses of 0.035 and 0.030 inch thick liners results in yet lower thermal stress of 8.50 ksi and 7.28 ksi respectively. Thus, for the thinner wall thicknesses, the amount of backside cooling can be increased while maintaining acceptable thermal stresses in the ceramic liner 140. Such additional cooling would allow higher combustor temperatures without violating the material temperature limits of ceramic liner 140.

Mechanical stresses on the ceramic liner 140, induced primarily by pressure differential thereacross have also been calculated for the three wall thicknesses 0.040, 0.035, and 0.030 inches. At a pressure differential of 1 psi the mechanical stress is 0.250, 0.286, and 0.333 ksi for the three wall thicknesses 0.040, 0.035, and 0.030 inches respectively. Thus, it will be evident that for low pressure drops across the liner, thermal stresses are far higher than mechanical stresses. Even for higher pressure drops, for example, 10 to 20 psi, the decrease in thermal stress is greater than the increase in mechanical stress as the thickness of the liner becomes less and less. On the other hand, the thinner liners have lower thermal stresses; thus higher pressure drops may be utilized if aerodynamically desired. The above analyses were conducted assuming a cylindrical ceramic wall having a radius of 10 inches.

The analyses of possible buckling under the external pressure load of various pressure drops across the thin ceramic liner 140 establishes that the pressure load capable of being maintained across the ceramic liner 140 is 16 psi and higher. Thus the pressure differential discussed above in analyzing mechanical stress appear within the capability of the materials from a buckling standpoint.

Analyses have also established the adequacy of the thin ceramic liner upon considering the relative thermal growth occurring within the structure of the present invention. For example, thermal expansion of SiC—SiC material is far less than that of a typical alloyed material which may be used in outer shell 122 such as INCO-718. To further compensate for the relative thermal growth, the radial pin attachment at one end of ceramic liner 140 allows for relative expansion without imparting significant stress to the liners. Additionally, the loosely nesting bosses 48, 54 associated with the primary dilution zone allows for relative thermal growth. Also, the spacing between boss 50 and the ceramic shell 140, creating orifice 52, is adequate to compensate for relative thermal growth.

Accordingly, it has been determined the primary concern for stress is the temperature differential across ceramic liner 140. The stress in the 0.040 inch liner thickness due to thermal effects approaches the material limit, allowing only a relatively small pressure drop (1–2 psi) across liner 140. Liners of thinner construction allow pressure drops up to 8 psi without creating structures difficult to manufacture or structure subject to buckling.

Various alterations and variations to the specific arrangements set forth above will be apparent to those skilled in the art. Accordingly the foregoing detailed description should be considered exemplary in nature and not as limiting to the scope and spirit of the invention as set forth in the appended claims.

Having described the invention with sufficient clarity that those skilled in the art may make and use it, what is claimed is:

1. A combustor for a gas turbine engine, comprising:

a combustor housing having an inlet for recieving pressurized air for combustion therein;

an outer metallic shell inside said housing and mounted thereto, said outer shell having primary and secondary air holes and a plurality of smaller cooling air holes; and an inner, thin walled, ceramic liner mounted to and disposed within said outer shell, and cooperating therewith to define a cooling space between said outer shell and said ceramic liner, said ceramic liner having primary and secondary openings respectively communicating with said primary and secondary air holes, said ceramic liner being otherwise nonporous, said cooling air holes adapted to direct the pressurized air into said cooling space for impingement cooling of said ceramic liner.

2. A combustor as set forth in claim 1, wherein said cooling space communicates with said primary and secondary openings in said ceramic liner for exhaust of cooling airflow from said cooling space.

3. A combustor as set forth in claim 1, further including conduit means extending across said cooling space from said primary and secondary air holes to said primary and secondary openings respectively, for directing pressurized air into a combustion zone inside said ceramic liner.

4. A combustor as set forth in claim 3, wherein said conduit means comprises outer bosses secured to said outer shell and extending to locations closely adjacent to but spaced from said ceramic liner such that said cooling space communicates with said primary and secondary openings in said ceramic liner for exhaust of cooling airflow from said cooling space.

5. A combustor as set forth in claim 4, said conduit means further including ceramic cylindrical bosses secured to said ceramic liner and extending toward said outer shell, said ceramic bosses nesting loosely within said outer bosses.

6. A combustor as set forth in claim 1, wherein each of said outer shell and said ceramic liner are of cylindrical configuration.

7. A combustor as set forth in claim 2, wherein further including means for securing one end of said ceramic liner to said outer shell.

8. A combustor as set forth in claim 7, wherein said combustor is cylindrical and defines a cylindrical combustion zone.

9. A combustor as set forth in claim 7, wherein said combustor is of annular configuration and defines an annularly shaped combustion zone.

10. A combustor as set forth in claim 1, wherein the wall thickness of said ceramic liner is no more than about 0.040 inches.

11. A combustor as set forth in claim 10, wherein said thickness is between about 0.030 and 0.040 inches, and said ceramic liner is a ceramic matrix composite of SiC—SiC.

12. A combustor for a gas turbine engine, comprising:

a combustor housing having inlets for recieving pressurized air and fuel for combustion therein;

an outer metallic shell in said housing and mounted thereto for carrying mechanical and pressure loads, said outer shell having primary and secondary air holes and a plurality of smaller cooling air holes; and an inner, thin walled, ceramic liner mounted within said outer shell for carrying substantially only thermal loads, said ceramic liner defining the outer aerodynamic boundary of the combustion process and defining a cooling space between outer shell and said ceramic liner, said ceramic liner having corresponding primary and secondary openings communicating with said primary and secondary air holes for delivery of primary air and dilution air for the combustion process, said ceramic liner being otherwise nonporous, said cooling air holes adapted to direct cooling airflow into said cooling space for impingement cooling of said ceramic liner, said cooling space communicating with said primary and secondary openings in said ceramic liner for exhaust of the cooling airflow from said cooling space substantially only through said primary and secondary openings.

13. A combustor as set forth in claim 11, further including means for defining first and second flow restricting orifices between said cooling space and said primary and secondary openings respectively, said second orifice being of larger area than said first orifice.

14. A gas turbine engine comprising:

compressor means for generating a pressurized air flow;

a combustor having a housing communicating with said compressor means to receive said pressurized airflow;

an outer, cylindrical metallic shell disposed within said housing and mounted thereto to carry mechanical and pressure loads, said shell having primary and secondary air holes and a plurality of smaller cooling air holes;

an inner, cylindrical, thin-walled, ceramic liner mounted to and disposed inside said shell to define a combustion zone inside said liner and an annular cooling space between said liner and said shell, said cooling air holes directing pressurized air into said annular cooling space to impingement cool said liner, said liner having primary and secondary openings respectively communicating with said primary and secondary air holes to deliver said pressurized airflow to said combustion zone, said liner being otherwise substantially nonporous; and means for delivering fuel to said combustion zone.

15. A gas turbine engine as set forth in claim 14, wherein said cooling space communicates with said primary and secondary openings in said ceramic liner for exhaust of cooling airflow from said cooling space.

16. A gas turbine engine as set forth in claim 15, further including means for defining first and second flow restricting orifices between said cooling space and said primary and secondary openings respectively, said second orifice being of larger area than said first orifice.

17. A gas turbine engine as set forth in claim 15, further including conduit means extending across said cooling space from said primary and secondary air holes to said primary and secondary openings respectively, for directing pressurized air into said combustion zone.

18. A gas turbine engine as set forth in claim 14, wherein said combustor is cylindrical and defines a cylindrical combustion zone.

19. A gas turbine engine as set forth in claim 14, wherein said combustor is of annular configuration and defines an annularly shaped combustion zone.

20. A gas turbine engine as set forth in claim 14, wherein the wall thickness of said ceramic liner is no more than about 0.040 inches.

21. A gas turbine engine as set forth in claim 20, wherein said thickness is between about 0.030 and 0.040 inches, and said ceramic liner is a ceramic matrix composite of SiC—SiC.

* * * * *